United States Patent [19]

Igarashi et al.

[11] Patent Number: 4,673,783

[45] Date of Patent: Jun. 16, 1987

[54] COMPACT HIGH-FREQUENCY HEATING APPARATUS WITH STEPPED WAVEGUIDE

[75] Inventors: Ryuji Igarashi; Yukio Suzuki, both of Aichi, Japan

[73] Assignee: Kabushiki Kaisha Toshiba, Kawasaki, Japan

[21] Appl. No.: 877,402

[22] Filed: Jun. 23, 1986

[30] Foreign Application Priority Data

| | | | |
|---|---|---|---|
| Jun. 24, 1985 | [JP] | Japan | 60-137320 |
| Jun. 26, 1985 | [JP] | Japan | 60-139353 |
| Oct. 18, 1985 | [JP] | Japan | 60-233080 |

[51] Int. Cl.[4] ..... H05B 6/72

[52] U.S. Cl. ..... 219/10.55 F

[58] Field of Search ..... 219/10.55 F, 10.55 A, 219/10.55 R, 10.55 E

[56] References Cited

U.S. PATENT DOCUMENTS

| | | | |
|---|---|---|---|
| 3,641,301 | 2/1972 | Ikeda | 219/10.55 F |
| 3,789,179 | 1/1974 | Haagensen | 219/10.55 F |
| 4,176,266 | 11/1979 | Kaneko et al. | 219/10.55 F |
| 4,296,297 | 10/1981 | Miller | 219/10.55 F |
| 4,304,974 | 12/1981 | Ikeda et al. | 219/10.55 F |
| 4,371,769 | 2/1983 | Yoshimura et al. | 219/10.55 F |
| 4,508,946 | 4/1985 | Yoshimura et al. | 219/10.55 F |

FOREIGN PATENT DOCUMENTS

| | | |
|---|---|---|
| 482735 | 4/1977 | Australia . |
| 533084 | 4/1980 | Australia . |
| 59-23196 | 2/1984 | Japan . |
| 2119210 | 11/1983 | United Kingdom . |
| 2127259 | 4/1984 | United Kingdom . |

*Primary Examiner*—Philip H. Leung

*Attorney, Agent, or Firm*—Cushman, Darby & Cushman

[57] ABSTRACT

A high-frequency heating apparatus includes an inner casing defining a heating chamber therein, and an outer casing surrounding the inner case. A fixed waveguide is fixed on a top wall of the inner casing to guide high-frequency waves fed from a magnetron to an excitation opening. The waveguide has a step portion facing the excitation opening and located closer to the top wall than the other portion of the fixed waveguide. A motor is mounted on the step portion and has a driving shaft extending through the excitation opening into the heating chamber. A rotating waveguide, for diffusing the high-frequency waves delivered to the excitation opening and radiating the waves into the heating chamber, is disposed in the heating chamber and coupled to the driving shaft to be rotated thereby.

14 Claims, 13 Drawing Figures

COMPACT HIGH-FREQUENCY HEATING APPARATUS WITH STEPPED WAVEGUIDE

BACKGROUND OF THE INVENTION

The present invention relates to a high-frequency heating apparatus, and more specifically to a high-frequency heating apparatus in which wave stirring means, e.g., a rotating waveguide, is provided in a heating chamber.

Recently there have been developed high-frequency heating apparatuses, such as microwave ovens, in which a rotating waveguide is rotatably disposed in a heating chamber so that high-frequency waves from the waveguide are introduced into the heating chamber to heat food therein.

The heating apparatuses of this type generally comprise an inner casing defining the heating chamber therein, and an excitation opening is formed in the top wall of the inner casing. A fixed waveguide is fixed on the top wall of the inner casing, having one end connected to the excitation opening and the other end to a magnetron. An electric motor is fixed on the fixed waveguide, and the rotating waveguide is located in the heating chamber so as to cover the excitation opening. The rotating waveguide is connected to the motor to be driven thereby. High-frequency waves emitted from the magnetron are fed into the rotating waveguide through the fixed waveguide and excitation opening and then radiated into the heating chamber.

The components, including the inner casing, motor, and magnetron, are housed in a cabinet. The height of the cabinet is determined on the basis of the sum of those of the inner casing, fixed waveguide, and motor. If the motor is set on the fixed waveguide as aforesaid, the height of the motor directly influences that of the cabinet, thus rendering the cabinet bulky. Accordingly, the prior art heating apparatuses of this type cannot meet the increasing demand for a compact design. Moreover, the bulky cabinet increases material cost. If the motor is on the fixed waveguide, furthermore, it must have a long driving shaft, resulting in a substantial vibration of the rotating waveguide during rotation. In this case, the rotating waveguide comes into contact with the inside of the inner casing, thereby causing noise or distortion of the rotating waveguide.

SUMMARY OF THE INVENTION

The present invention has been conceived in consideration of these circumstances and is intended to provide a high-frequency heating apparatus in a compact external design, without a reduction in the size of the heating chamber, for reducing the vibration of the rotating waveguide.

In order to achieve the above object, according to the invention, there is provided a high-frequency heating apparatus comprising an inner casing defining a heating chamber therein, the inner casing including a top wall having an excitation opening; a high-frequency oscillator for generating high-frequency waves; a fixed waveguide fixed on the top wall of the inner casing and having one end communicating with the excitation opening and the other end connected to the high-frequency oscillator means for guiding the high-frequency waves fed from the high-frequency oscillator means to the excitation opening, the fixed waveguide including a step portion facing the excitation opening and located closer to the top wall than the other portion of the fixed waveguide; drive means mounted on the step portion of the fixed waveguide and including a driving shaft extending through the excitation opening into the heating chamber; a rotating waveguide for diffusing the high-frequency waves delivered to the excitation opening and radiating the waves into the heating chamber, the rotating waveguide being disposed in the heating chamber so as to cover the excitation opening and coupled to the driving shaft to be rotated by the drive means; and an outer casing surrounding all of the components.

BRIEF DESCRIPTION OF THE DRAWINGS

FIGS. 1 to 5D show a high-frequency heating apparatus according to an embodiment of the present invention, in which:

FIG. 1 is a sectional view of the apparatus;

FIG. 2 is a sectional view taken along line II—II of FIG. 1;

FIG. 3 is a perspective view of a rotating waveguide;

FIG. 4 is an enlarged sectional view showing an excitation opening and its surroundings; and FIGS. 5A to 5D are schematic views illustrating different operating states of the rotating waveguide;

DETAILED DESCRIPTION OF THE PREFERRED EMBODIMENT

A high-frequency heating apparatus according to an embodiment of the present invention will now be described in detail with reference to the accompanying drawings.

Figure 1:
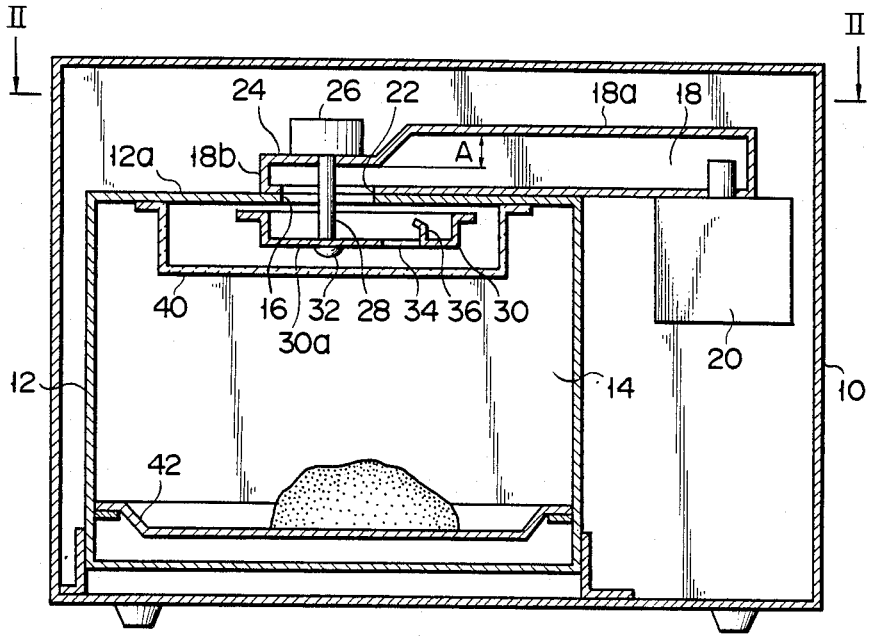

As shown in FIG. 1, the heating apparatus comprises outer casing 10 and inner casing 12 therein. The inner casing defines heating chamber 14. Heating chamber 14 opens at the front and its front opening is opened and closed by a door (not shown) which is supported by the outer casing. Circular excitation opening 16 is formed in top wall 12*a* of inner casing 12. Fixed waveguide 18 with a rectangular tubular shape is fixed to the upper surface of top wall 12*a*. One end of waveguide 18 extends up to the region over opening 16, while its other end projects outward from inner casing 12. A high-frequency oscillator or magnetron 20 is fixed to the other end of waveguide 18. Circular wave feed port 22 is bored through the bottom wall of the one end portion of waveguide 18. It has the same size as and is coaxial with opening 16. Opening 16 and port 22 are 70 mm or more in diameter. High-frequency waves generated from magnetron 20 are led into heating chamber 14 via waveguide 18, port 22, and opening 16.

Figure 2:
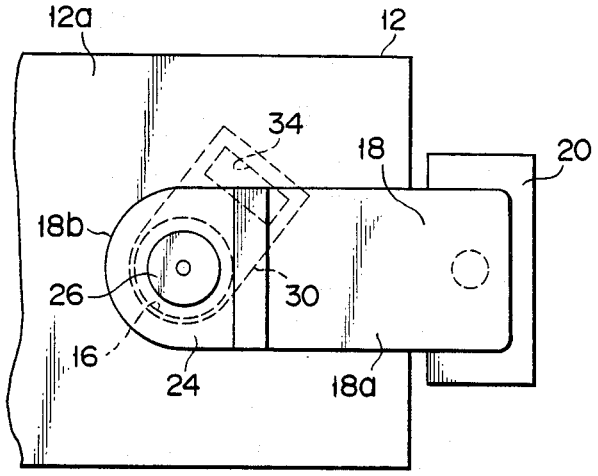

That portion of top wall 18*a* of fixed waveguide 18 which faces excitation opening 16 is lower than the remaining top wall portion by height A. Namely, it is located closer to top wall 12*a* of inner casing 12 by distance A, thus defining step portion 24. As shown in FIG. 2, side wall 18*b* at one end side of waveguide 18 is semicircular and coaxial with opening 16. Waveguide 18, including step portion 24, is formed by bending. As for side wall 18*b*, however, it is formed by drawing.

Electric motor 26 is fixed on step portion 24 of waveguide 18. Driving shaft 28 of motor 26 extends through feed port 22 and excitation opening 16 into heating chamber 14. Shaft 28 is located coaxial with opening 16 and is formed from a heat-resistant dielectric substance, e.g., fluorine plastic. Rotating waveguide 30 in chamber 14 is fixed to the extended end of shaft 28 and is rotated by motor 26. Rotating waveguide 30 is formed from a conductive material, such as aluminum, into a thin, opentopped box. Alternatively, waveguide 30 may be formed from synthetic resin. In this case, the surface of the resin or plastic structure is plated with metal.

Figure 3:
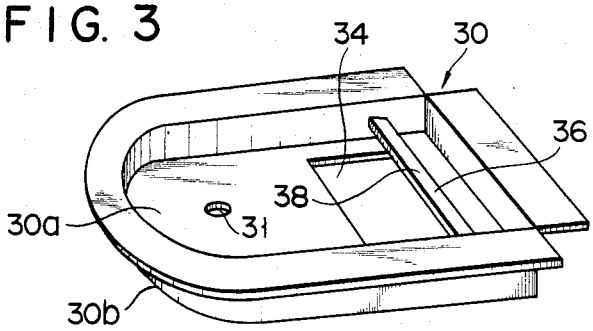
Figure 4:
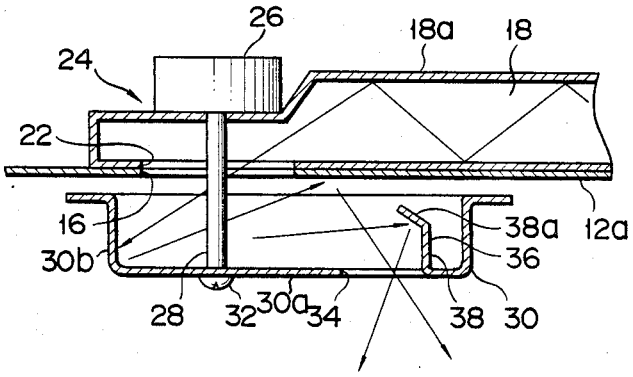
Figure 5A:
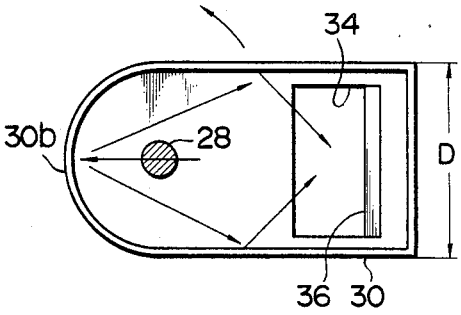
Figure 5B:
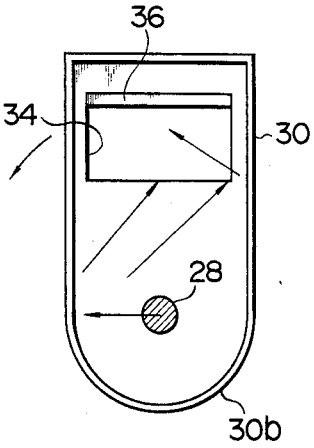
Figure 5C:
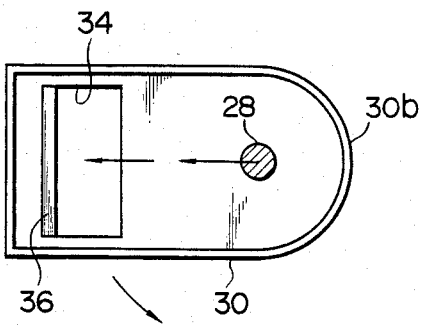
Figure 5D:
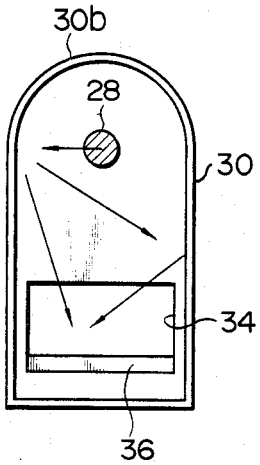

As seen from FIGS. 2 and 3, the rotating waveguide has a rectangular bottom wall 30*a*. Fixing hole 31 for fixing driving shaft 28 is formed in wall 30*a*, biased to one end side from the center of the wall. The width of wall 30*a* is greater than the diameter of excitation opening 16. The extended end of shaft 28 is fixed in hole 31 of wall 30*a* by means of fixing screw 32. Rotating waveguide 30 is supported with its opening upward or facing top wall 12*a* of inner casing 12 and so as to cover opening 16. In particular, side wall 30*b* at one end of waveguide 30 is semicircular and coaxial with opening 16. Rectangular radiation aperture 34 is formed at that end portion of bottom wall 30*a* of waveguide 30 which is opposite to the end portion formed with fixing hole 31. It extends along the width of wall 30*a*. Wave reflecting portion 36 is formed along that side edge of aperture 34 which extends in the transverse direction of bottom wall 30*a* and is located on the opposite side of the aperture to hole 31. Portion 36 is composed of raised piece 38 which is formed, during the formation of aperture 34 of bottom wall 30*a*, by raising up that wall portion having so far been protruding over aperture 34 so that the wall portion protrudes upright toward the top opening of rotating waveguide 30. The free end of piece 38 is bent toward fixing hole 31 to form slant portion 38*a* as shown in FIG. 4. Thus, reflecting portion 36 is formed integrally with rotating waveguide 30. The height of portion 36 and the tilt angle of portion 38*a* are set in accordance with the shape and size of heating chamber 14 so that the high-frequency waves delivered from excitation opening 16 into waveguide 30 can be reflected and applied to every corner of the inside of chamber 14 through radiation aperture 34.

Diaphragm 40 is fixed to the inner surface of top wall 12*a* of inner casing 12, covering rotating waveguide 30 for protection. It is formed of a material with high radiotransparency, such as heat-resistant resin. Tray 42 for supporting a dish or food is provided at the bottom of heating chamber 14.

The operation and use of the high-frequency heating apparatus with the aforementioned construction will now be described in detail.

First, food to be cooked is placed on tray 42 in heating chamber 14, and a control switch (not shown) is activated. As a result, motor 26 is actuated to rotate rotating waveguide 30, and high-frequency waves or microwaves are emitted from magnetron 20. As shown in FIG. 4, the emitted microwaves are guided in fixed waveguide 18 and led into rotating waveguide 30 through feed port 22 and excitation opening 16. Then, the microwaves are fed into chamber 14 through radiation aperture 34 of rotating waveguide 30 which rotates around driving shaft 28. In doing this, the waves are fully stirred by the rotation of waveguide 30. The food is heated and cooked by the waves.

More specifically, since side wall 30*b* of rotating waveguide 30 is semicircular in shape, the microwaves introduced into waveguide 30 are always reflected uniformly toward radiation aperture 34, as shown in FIGS. 5A to 5D, without regard to the angular position of the waveguide. As shown in FIG. 4, the waves are further reflected by reflecting portion 36 and fed through aperture 34 into heating chamber 14.

Constructed in this manner, the high-frequency heating apparatus of the invention has the following advantages.

Fixed waveguide 18 is provided with step portion 24 which is located over excitation opening 16 and lower than the remaining portion by height A, and motor 26 is mounted on the step portion. Therefore, the distance between the top surface of motor 26 and the top wall of inner casing 12 can be made shorter, by distance A, than in the conventional case where the motor is mounted on the fixed waveguide without any step portion. Accordingly, the height of outer casing 10, required to house inner casing 12, fixed waveguide 18, and motor 26, can be made shorter than that of the prior art counterpart by height A. Thus, outer casing 10 can be made compact without changing the capacity of heating chamber 14. If the outer casing can be reduced in size in this manner, then the material cost and hence manufacturing cost of the apparatus can be reduced proportionately.

Since motor 26 is set in a lower position, moreover, driving shaft 28 can be shortened by length A. As a result, vibration of rotating waveguide 30 during rotation can be attenuated, and waveguide 30 can be prevented from touching top wall 12*a* of inner casing 12. Thus, the microwaves can efficiently be applied at all times without noise due to the contact between waveguide 30 and wall 12*a* or distortion of the rotating waveguide. Overlying excitation opening 16, step portion 24 neither influences the microwaves passing through fixed waveguide 18 nor produces undesired reflected waves.

Since reflecting portion 36 is provided at radiation aperture 34 of rotating waveguide 30, the microwaves delivered to waveguide 30 are diffused by portion 36 as well as by the rotation of waveguide 30. Accordingly, the waves are radiated in all directions in heating chamber 14 from aperture 34, uniformly covering the whole inside space of the heating chamber. Thus, the microwaves can be applied uniformly to the top and peripheral portions of the food for uniform heating even if the food is bulky or located in a corner of chamber 14. The uniform application of the microwaves ensures greater food heating efficiency.

Reflecting portion 36 is formed by raising up part of bottom wall 30*a* of rotating waveguide 30 during the formation of radiation aperture 34 in the bottom wall. Accordingly, portion 36 requires no exclusive-use components therefor and can be formed integrally with the rotating waveguide by pressing or the like. Thus, it can easily be manufactured at low cost. It serves not only to diffuse the microwaves but also to increase the rigidity of rotating waveguide 30, thereby preventing distortion of waveguide 30. If distorted, the rotating waveguide will possibly spark due to concentration of the magnetic field.

Figure 6:
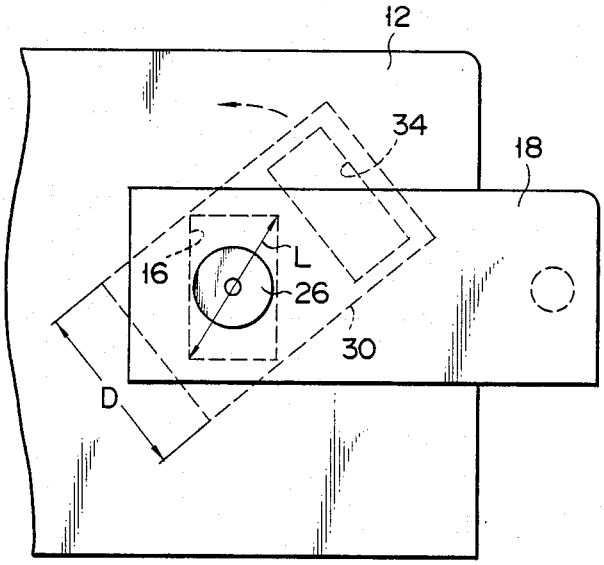
FIG. 6 is a sectional view similar to FIG. 2, showing a case in which the excitation opening is rectangular.

Feed port 22 of fixed waveguide 18 and excitation opening 16 are circular in shape, so that width D (FIG. 5A) of rotating waveguide 30 can be made substantially equal to the diameter of port 22 and opening 16. In FIG. 6, port 22 and opening 16 are rectangular. In this case, width D of waveguide 30 should be greater than length L of a diagonal line of opening 16 so that the microwaves introduced from opening 16 into waveguide 30 are prevented from leaking out without regard to the rotational position of waveguide 30. Thus, rotating waveguide 30 is large and heavy, so that the microwaves are subject to a substantial output loss. Also, a large motor must be used as drive means for rotating the rotating waveguide. In contrast to FIG. 6, according to this embodiment, feed port 22 and excitation opening 16 are circular, so that waveguide 30 can be made small and light in weight. Accordingly, the output loss of the microwaves in the rotating waveguide are reduced, and a small drive motor can be used as the drive means, resulting in a reduction in cost.

Figure 7:
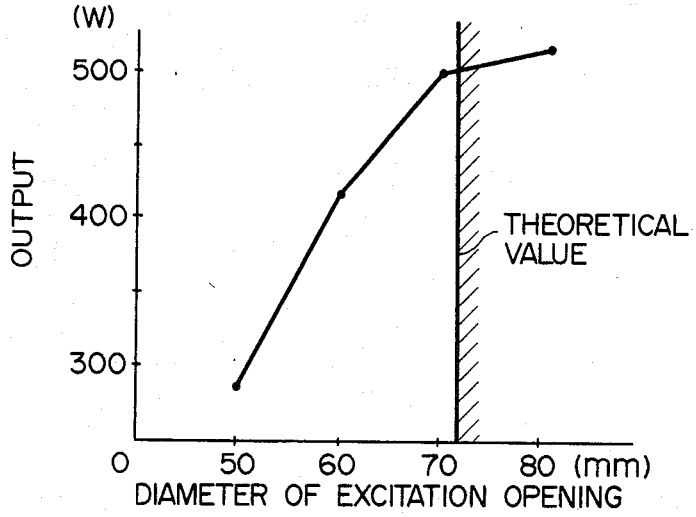
FIG. 7 shows a characteristic curve representing the relationship between the diameter of the excitation opening and high-frequency output.

Further, the diameter of feed port 22 and excitation opening 16 is set to be 70 mm or more. In this case, as seen from FIG. 7 showing the result of an experiment, the output can be higher than in the case where the diameter is less than 70 mm. If port 22 and opening 16 are regarded as a waveguide with a circular cross section, there are relations:

$$d=2r,$$

and $$\lambda c=2\pi r/1.841=3.412r,$$

where d is the diameter of port 22 and opening 16, and λc is cut-off wavelength.

If frequency f of high-frequency waves is f=2,450 MHz, wavelength λc is 122.4 mm, so that we obtain r=35.9 mm and therefore d=2×35.9 mm=71.8 mm (theoretical value).

This calculation result indicates that the high-frequency output is improved if diameter d of feed port 22 and excitation opening 16 is 70 mm or more.

Side wall **18*b* of fixed waveguide 18 on the side of excitation opening 16 is semicircular and coaxial with opening 16. It can therefore efficiently reflect the microwaves, reducing their output loss. Thus, the high-frequency output is improved. During the manufacture of waveguide 18, moreover, the end portion on the side of side wall 18*b* can be formed by drawing, without requiring spot welding of corner portions or any other troublesome work which is necessary if the end portion is square-shaped. Thus, the fixed waveguide can be easily manufactured at a low cost. Even if side wall 18*b* is concentric to excitation opening 16**, it can provide the same effects as aforesaid as long as it is semicircular.

According to this embodiment, moreover, side wall **30*b* of rotating waveguide 30 on the side of excitation opening 16 is semicircular. Therefore, the microwaves introduced into waveguide 30 can be reflected in various directions, improving their efficiency of reflection. Thus, the high-frequency output loss can be reduced, and the microwaves reflected reversely from rotating waveguide side to magnetron side can be reduced in volume. In consequence, magnetron 20 and waveguide 30** can be prevented from undergoing a temperature rise.

Figure 8:
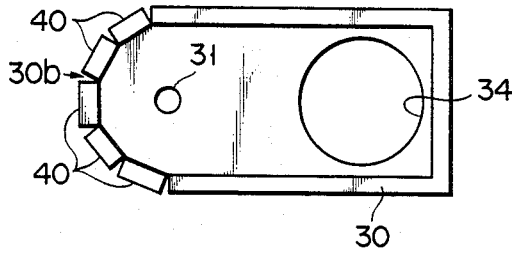
FIG. 8 is a plan view showing a first modification of the rotating waveguide.

It is to be understood that the present invention is not limited to the embodiment described above and that various changes and modifications may be effected therein by one skilled in the art without departing from the scope or spirit of the invention. As shown in FIG. 8, for example, side wall **30*b* of rotating waveguide 30 may be formed of a number of bent portions 40 arranged substantially in the form of a polygon resembling a semicircle. Also, radiation aperture 34** may be shaped like a circle. This arrangement provides the same functions or effects as the above described embodiment.

Figure 9:
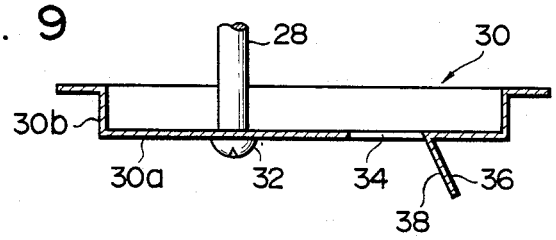
FIGS. 9 and 10 are sectional views showing second and third modifiction, respectively, of the rotating waveguide.
Figure 10:
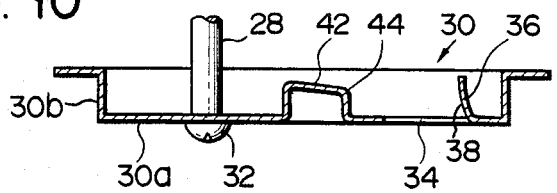

In contrast with the above embodiment, furthermore, reflecting portion 36 of rotating waveguide 30 may be formed by bending raised piece 38 downward, as shown in FIG. 9. Also, reflecting portion 36 is not limited to one in number, that is, waveguide 30 may be provided with two or more reflecting portions. As shown in FIG. 10, for example, the rotating waveguide may include second reflecting portion 42 as well as portion 36. Portion 42 consists of projection 44 which is formed by projecting part of bottom wall **30*a* of waveguide 30, e.g., that portion between fixing hole 31 and radiation aperture 34. The microwaves delivered to waveguide 30 are diffusely reflected by projection 44 and then by raised piece 38, and are thereafter radiated in all directions in heating chamber 14 from aperture 34. According to this modified example, projection 44 and piece 38 combine their wave reflecting effects in synergism, so that the microwaves can be diffused more randomly than in the above embodiment. Projection 44 is not limited to one in number, that is, waveguide 30 may be provided with two or more projections. Moreover, the same effects of the above embodiment may be obtained if only projection 44 is provided without the formation of raised piece 38**.

The drive means for driving rotating waveguide 30 is not limited to an electric motor, and may be any other suitable mechanism, such as pneumatic moving vanes. In this case, the vanes are rotatably mounted on step portion 24 of fixed waveguide 18 and coupled to driving shaft 28. They are rotated by air for cooling magnetron 20.

What is claimed is:

1. A high-frequency heating apparatus comprising:

an inner casing defining a heating chamber therein, said inner casing including a top wall having a circular excitation opening;

high-frequency oscillator means for generating high-frequency waves;

a fixed waveguide fixed on the top wall of the inner casing and having one end communicating with the excitation opening and the other end connected to the high-frequency oscillator means, for guiding the high-frequency waves fed from the high-frequency oscillator means to the excitation opening, said fixed waveguide including a step portion facing the excitation opening and located closer to the top wall than the other portion of the fixed waveguide, said end of the fixed waveguide communicating with the excitation opening and having a semicircular side wall extending substantially perpendicularly to the top wall of the inner casing, said side wall having a central axis coaxial with the excitation opening;

a motor mounted on the step portion of the fixed waveguide and including a driving shaft extending through the excitation opening into the heating chamber and coaxial with the excitation opening;

a rotating waveguide for diffusing the high-frequency waves delivered to the excitation opening and radiating the waves into the heating chamber, said rotating waveguide being disposed in the heating chamber such that one end of the rotating waveguide covers the excitation opening and is coupled to the driving shaft to be rotated by the motor; and an outer casing surrounding said inner casing, said high-frequency oscillator means, said fixed waveguide, said motor, and said rotating waveguide.

2. A high-frequency heating apparatus according to claim 1, wherein said excitation opening is 70 mm or more in diameter.

3. A high-frequency heating apparatus according to claim 1, wherein said rotating waveguide is substantially in the form of a box having a substantially rectangular bottom wall opposite to the top wall of the inner casing and a top opening facing the top wall, said driving shaft having its extended end fixed on the center line of the bottom wall, said bottom wall having a width substantially equal to the diameter of the excitation opening.

4. A high-frequency heating apparatus according to claim 3, wherein the extended end of said driving shaft is fixed to the bottom wall of said rotating waveguide so as to be biased to one end side of the bottom wall with respect to the longitudinal direction thereof, said bottom wall having a wave radiation aperture formed at the other end side thereof.

5. A high-frequency heating apparatus according to claim 4, wherein that end portion of said rotating waveguide to which the driving shaft is fixed is substantially semicircular and coaxial with the excitation opening.

6. A high-frequency heating apparatus according to claim 4, wherein said wave radiation aperture is circular.

7. A high-frequency heating apparatus according to claim 1, wherein said rotating waveguide is substantially in the form of a box having a substantially rectangular bottom wall opposite to the top wall of the inner casing and a top opening facing the top wall, said driving shaft extending perpendicularly to the top wall of the inner casing and having its extended end fixed on the center line of the bottom wall, said bottom wall having a wave radiation aperture.

8. A high-frequency heating apparatus according to claim 7, wherein said rotating waveguide includes reflecting means for diffusely reflecting the high-frequency waves introduced into the rotating waveguide so that the waves are radiated through the wave radiation aperture.

9. A high-frequency heating apparatus according to claim 8, wherein said wave radiation aperture is in the form of a rectangle extending in the transverse direction of the bottom wall of the rotating waveguide, and said reflecting means includes a projection formed along that side edge of the radiation aperture which extends in the transverse direction of the bottom wall and is more distant from the driving shaft.

10. A high-frequency heating apparatus according to claim 9, wherein said projection protrudes from the bottom wall toward the top wall of the inner casing.

11. A high-frequency heating apparatus according to claim 9, wherein said projection protrudes from the bottom wall on the opposite side thereof to the top wall of the inner casing.

12. A high-frequency heating apparatus according to claim 9, wherein said projection is a raised piece formed by raising part of the bottom wall.

13. A high-frequency heating apparatus according to claim 8, wherein said reflecting means includes a projection formed on the bottom wall between the driving shaft and the radiation aperture, extending in the transverse direction of the bottom wall.

14. A high-frequency heating apparatus according to claim 13, wherein said projection protrudes from the bottom wall toward the top wall of the inner casing.

* * * * *